US006659194B1

(12) United States Patent
Thompson

(10) Patent No.: US 6,659,194 B1
(45) Date of Patent: Dec. 9, 2003

(54) BLADE ANGLE ADJUSTMENT SYSTEM

(76) Inventor: Samuel C. Thompson, 10800 E. 7120 N., P.O. Box #67, Lapoint, UT (US) 84039

( * ) Notice: Subject to any disclaimer, the term of this patent is extended or adjusted under 35 U.S.C. 154(b) by 0 days.

(21) Appl. No.: 10/302,583

(22) Filed: Nov. 22, 2002

(51) Int. Cl.[7] ..... E02F 3/76
(52) U.S. Cl. ..... 172/818
(58) Field of Search ..... 172/818, 819, 172/820, 821, 822, 823, 811, 815, 813

(56) References Cited

U.S. PATENT DOCUMENTS

| | | | | | |
|---|---|---|---|---|---|
| 2,089,485 | A | * | 8/1937 | Knapp | 172/831 |
| 2,224,725 | A | | 12/1940 | Felt, Jr. | |
| 2,326,338 | A | * | 8/1943 | Drott et al. | 37/409 |
| 2,365,677 | A | * | 12/1944 | Burns | 172/818 |
| 2,371,502 | A | * | 3/1945 | Burns | 172/818 |
| D143,353 | S | | 12/1945 | Rockwell | |
| 2,766,536 | A | | 10/1956 | Perkins | |
| 3,157,099 | A | * | 11/1964 | Ulrich | 172/815 |
| 3,378,084 | A | * | 4/1968 | Ulrich | 172/247 |
| 3,400,767 | A | * | 9/1968 | Hermiz | 172/820 |
| 3,648,782 | A | * | 3/1972 | Mazzarins | 172/821 |
| 3,656,559 | A | * | 4/1972 | Lennea et al. | 172/818 |
| 3,662,838 | A | * | 5/1972 | Polzin et al. | 172/823 |
| 4,079,791 | A | * | 3/1978 | Yoder et al. | 172/815 |
| 4,201,268 | A | | 5/1980 | Frisbee | |
| 4,241,794 | A | * | 12/1980 | Halterman, Jr. | 172/818 |
| 4,487,269 | A | * | 12/1984 | Frisbee | 172/818 |
| 4,999,022 | A | * | 3/1991 | Veys | 414/718 |
| 5,152,351 | A | * | 10/1992 | Rieger | 172/813 |
| 5,813,476 | A | * | 9/1998 | Semper | 172/822 |
| 6,059,048 | A | | 5/2000 | Subrt | |
| 6,105,682 | A | | 8/2000 | Recker et al. | |

* cited by examiner

*Primary Examiner*—Victor Batson

(57) ABSTRACT

A blade angle adjustment system for adjusting the angle of the blade with respect to the body of a bulldozer. The blade angle adjustment system includes a pair of sleeve assemblies each being designed for being slidably coupled to one of a pair of lifting arms of the bulldozer. Each of the sleeve assemblies comprises a mounting member coupled to a main portion of an associated one of the sleeve assemblies whereby the mounting member is designed for pivotally receiving one of a pair of pivot arms each of the sleeve assemblies is designed for being coupled to one of a pair of extending rams of the bulldozer whereby lengthening of one of the extending rams slides the associated one of the sleeve assemblies along the associated one of the lifting arms for changing angle the blade with respect to a body of the bulldozer.

8 Claims, 6 Drawing Sheets

BLADE ANGLE ADJUSTMENT SYSTEM

BACKGROUND OF THE INVENTION

1. Field of the Invention

The present invention relates to bulldozer blade angle adjuster devices and more particularly pertains to a new blade angle adjustment system for adjusting the angle of the blade with respect to the body of a bulldozer.

2. Description of the Prior Art

The use of bulldozer blade angle adjuster devices is known in the prior art. U.S. Pat. No. 2,766,536 describes a system for hydraulically adjusting the angle of the blade of a bull dozer. Another type of bulldozer blade angle adjuster device is U.S. Pat. No. 2,224,725 having a device for tilting the blade of the bulldozer. U.S. Pat. No. Des. 143,353 shows a bulldozer. U.S. Pat. No. 6,059,048 has an implement mounting arrangement that allows for adjusting of the angle of the blade of the bulldozer. U.S. Pat. No. 4,201,268 has a mechanism for adjusting the angle, pitch and tilt of a blade of a bulldozer. U.S. Pat. No. 6,105,682 has an apparatus for controlling an earthworking implement.

While these devices fulfill their respective, particular objectives and requirements, the need remains for a system that has certain improved features that allow use of the existing hydraulics of the bulldozer.

SUMMARY OF THE INVENTION

The present invention meets the needs presented above by providing a pair of sleeve assemblies that are each slidably coupled one of a pair of lifting arm and coupled to the pivot arms and extending rams for allowing one of the sliding assemblies to be repositioned with respect to other to change the angle of the blade.

Still yet another object of the present invention is to provide a new blade angle adjustment system that allows modification of an existing bulldozer without having add additional hydraulic systems to change the angle of the blade.

Even still another object of the present invention is to provide a new blade angle adjustment system that permits the user to change the angle of the blade while the user is positioned in the cab of the bulldozer.

To this end, the present invention generally comprises a pair of sleeve assemblies each being designed for being slidably coupled to one of a pair of lifting arms of the bulldozer. Each of the sleeve assemblies comprises a mounting member coupled to a main portion of an associated one of the sleeve assemblies. The mounting member of each of the sleeve assemblies is designed for pivotally receiving one of a pair of pivot arms of the bulldozer whereby each of the pivot arms is pivotable with respect to the associated one of the lifting arms each of the sleeve assemblies is designed for being coupled to one of a pair of extending rams of the bulldozer whereby lengthening of one of the extending rams slides the associated one of the sleeve assemblies along the associated one of the lifting arms for changing the positioning of one of the pivot arms with respect to the other of the pivot arms to angle the blade with respect to a body of the bulldozer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
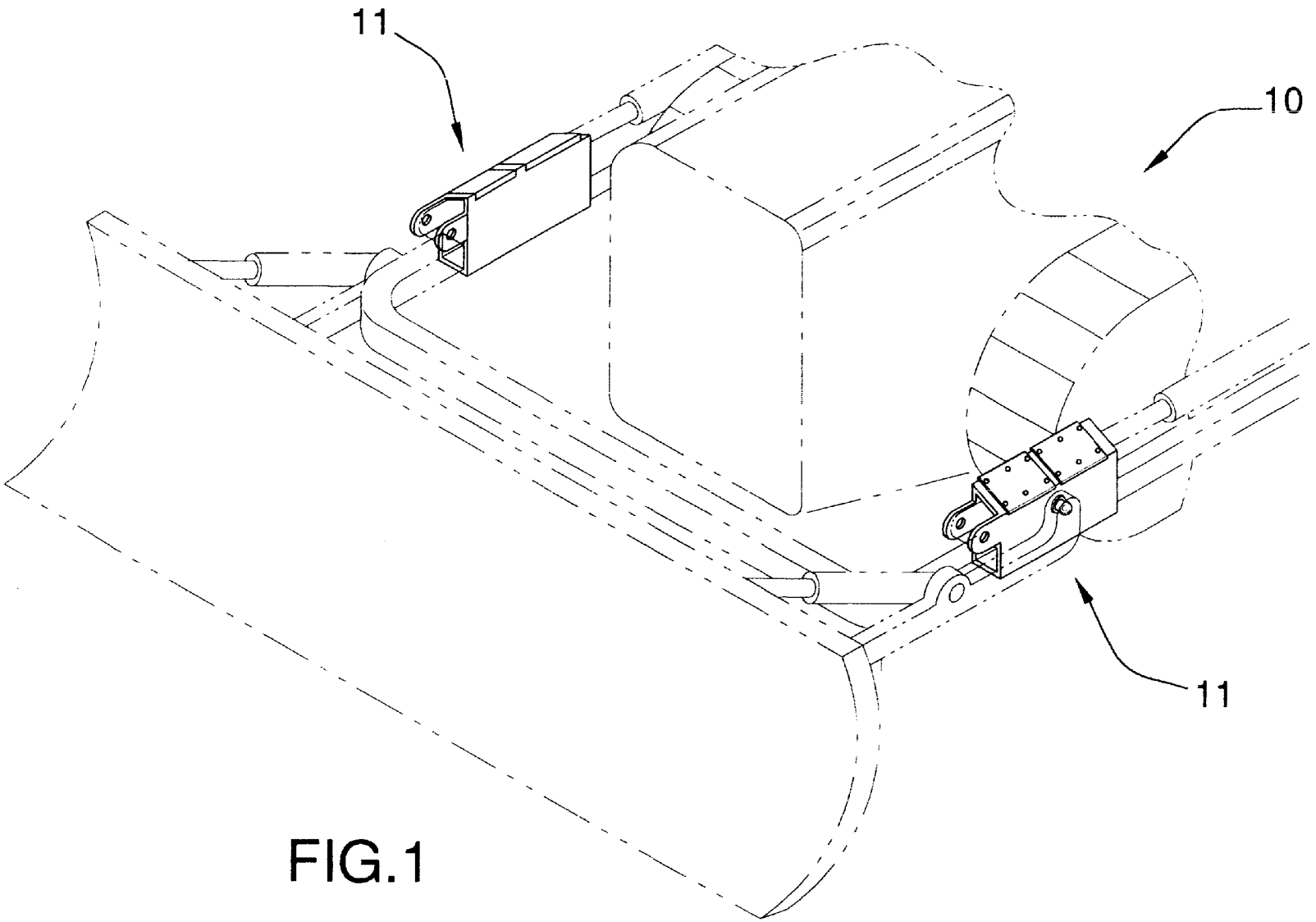
FIG. 1 is a perspective view of a new blade angle adjustment system according to the present invention shown in use.
Figure 2:
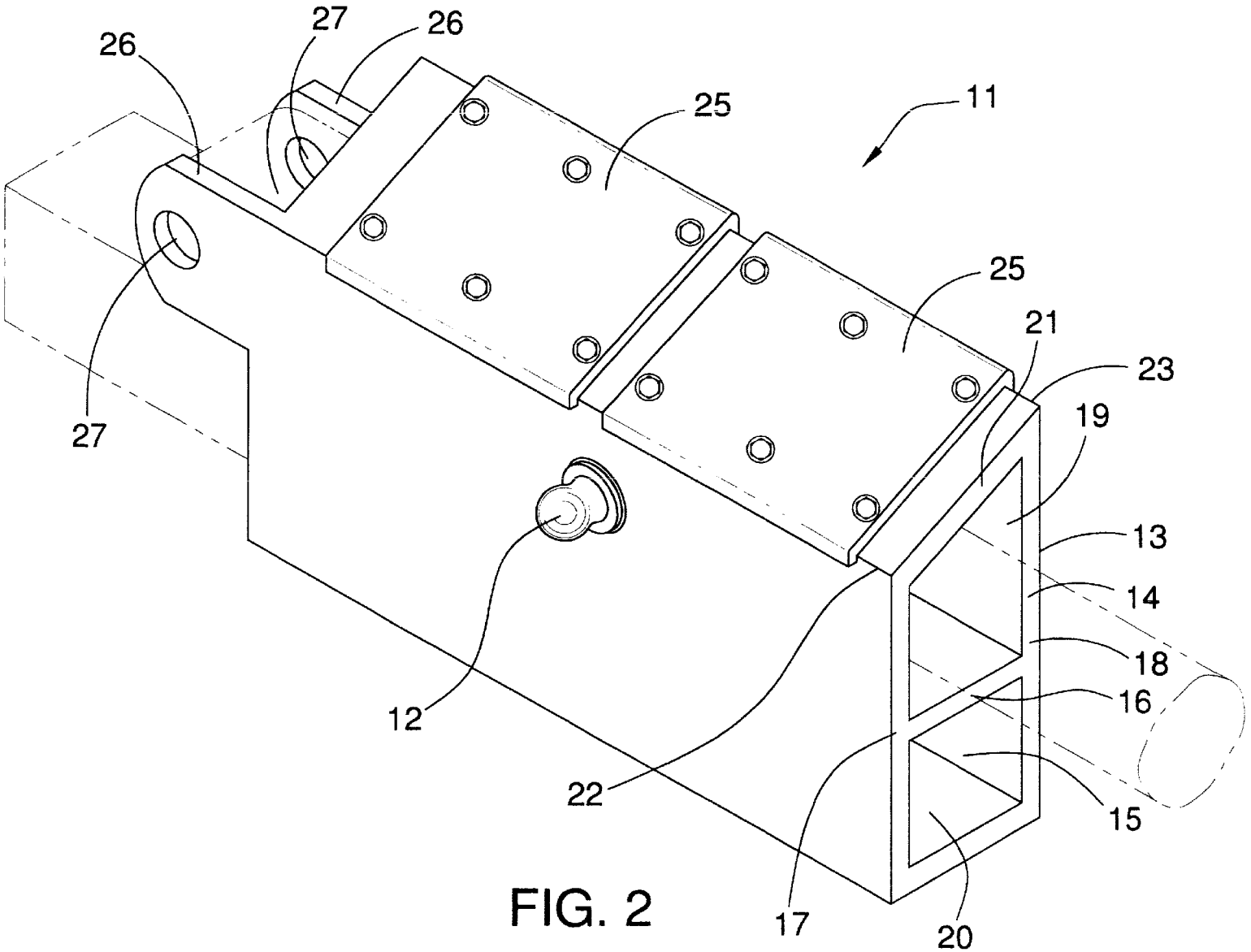
FIG. 2 is a schematic perspective view of one of the sleeve assemblies of the present invention.
Figure 3:
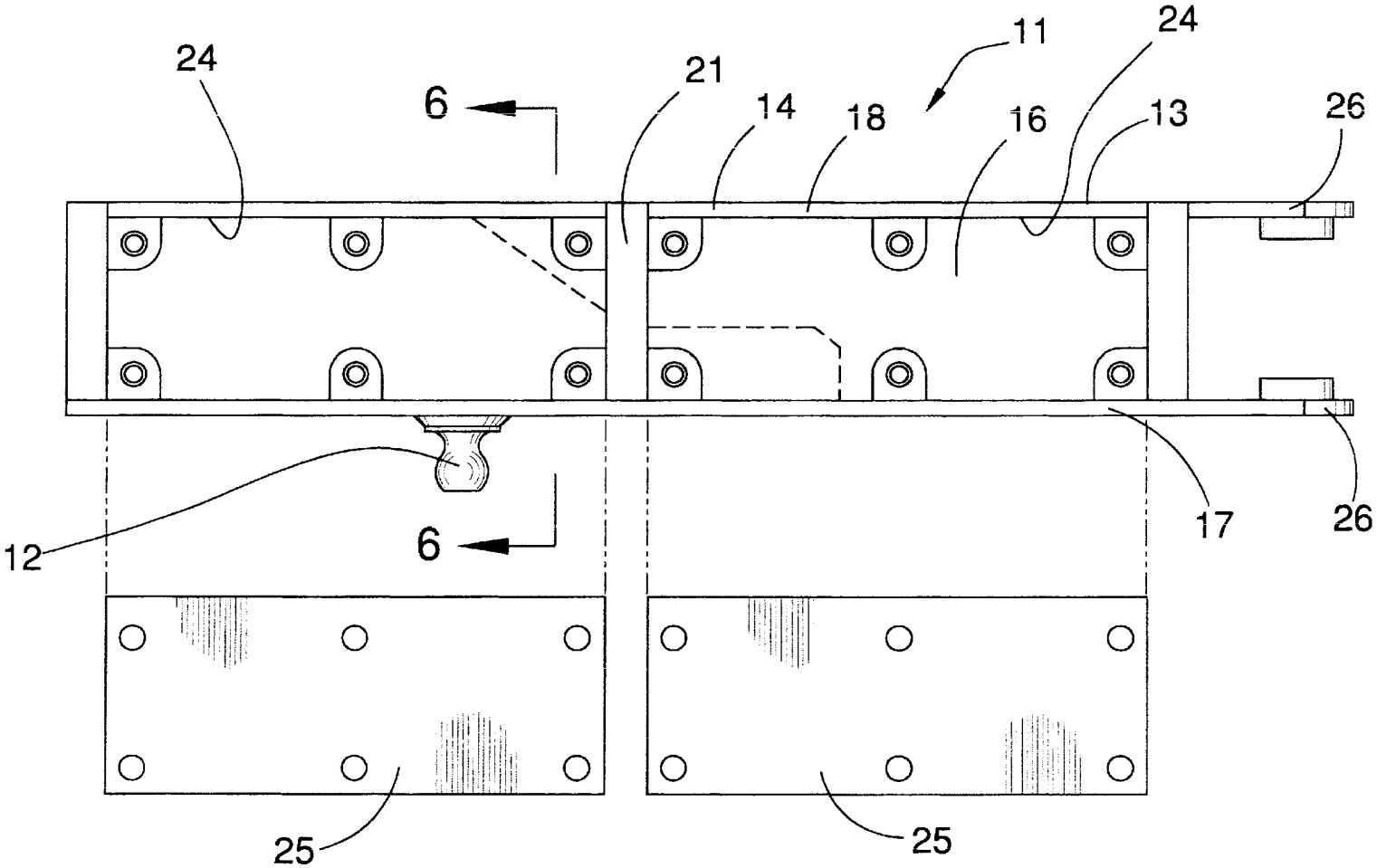
FIG. 3 is a top exploded view of one of the sleeve assemblies of the present invention.
Figure 4:
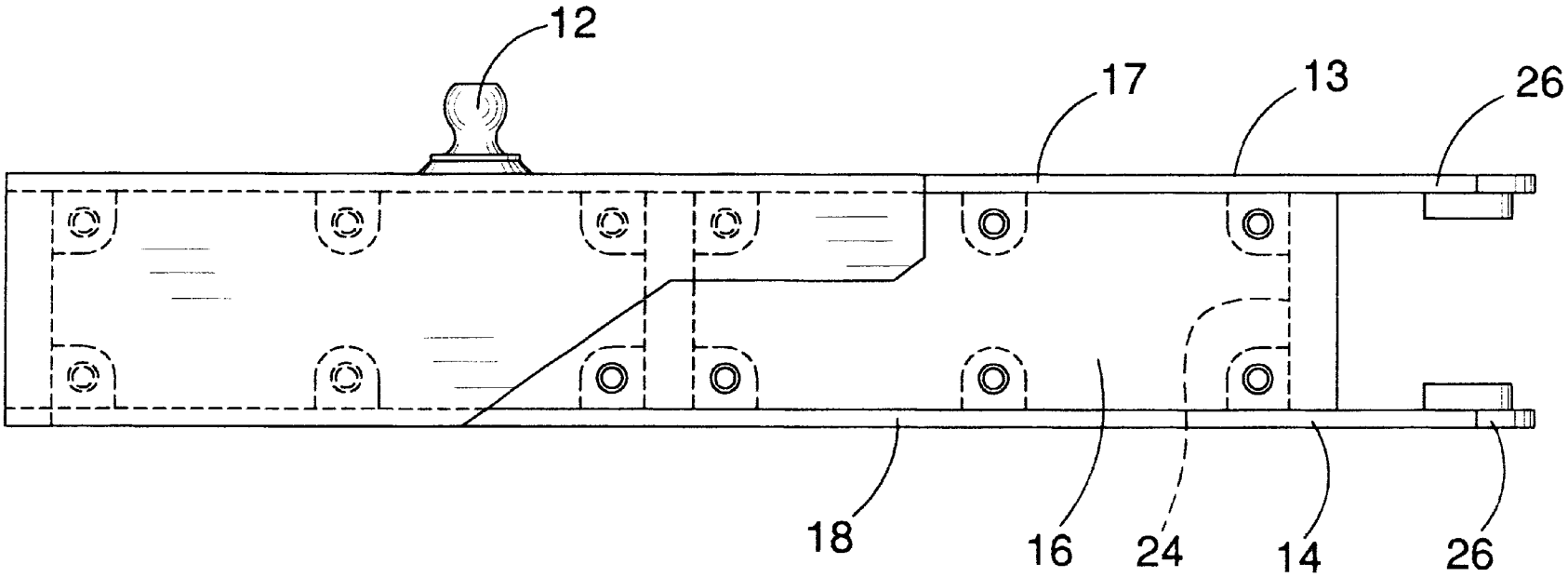
FIG. 4 is a bottom view of one of the sleeve assemblies of the present invention.
Figure 5:
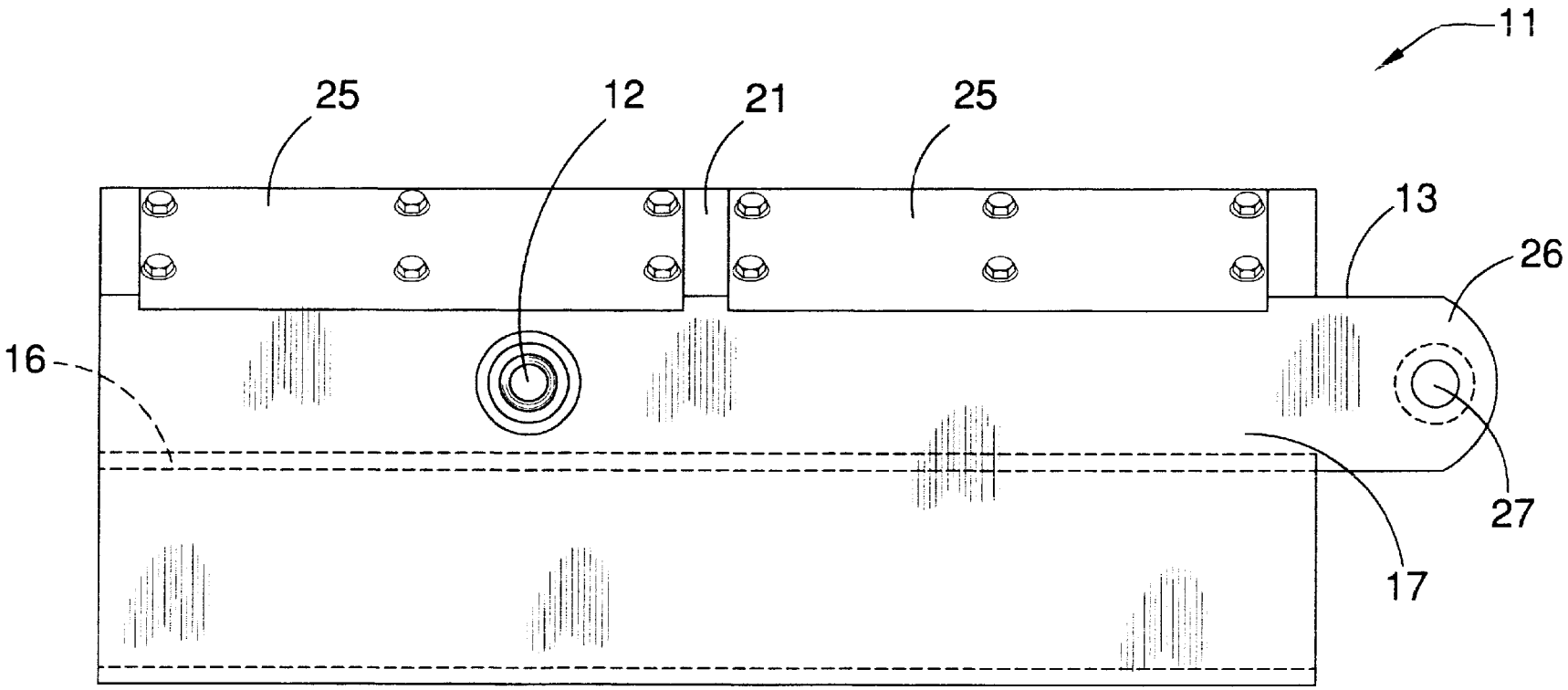
FIG. 5 is a side view of one of the sleeve assemblies of the present invention.
Figure 6:
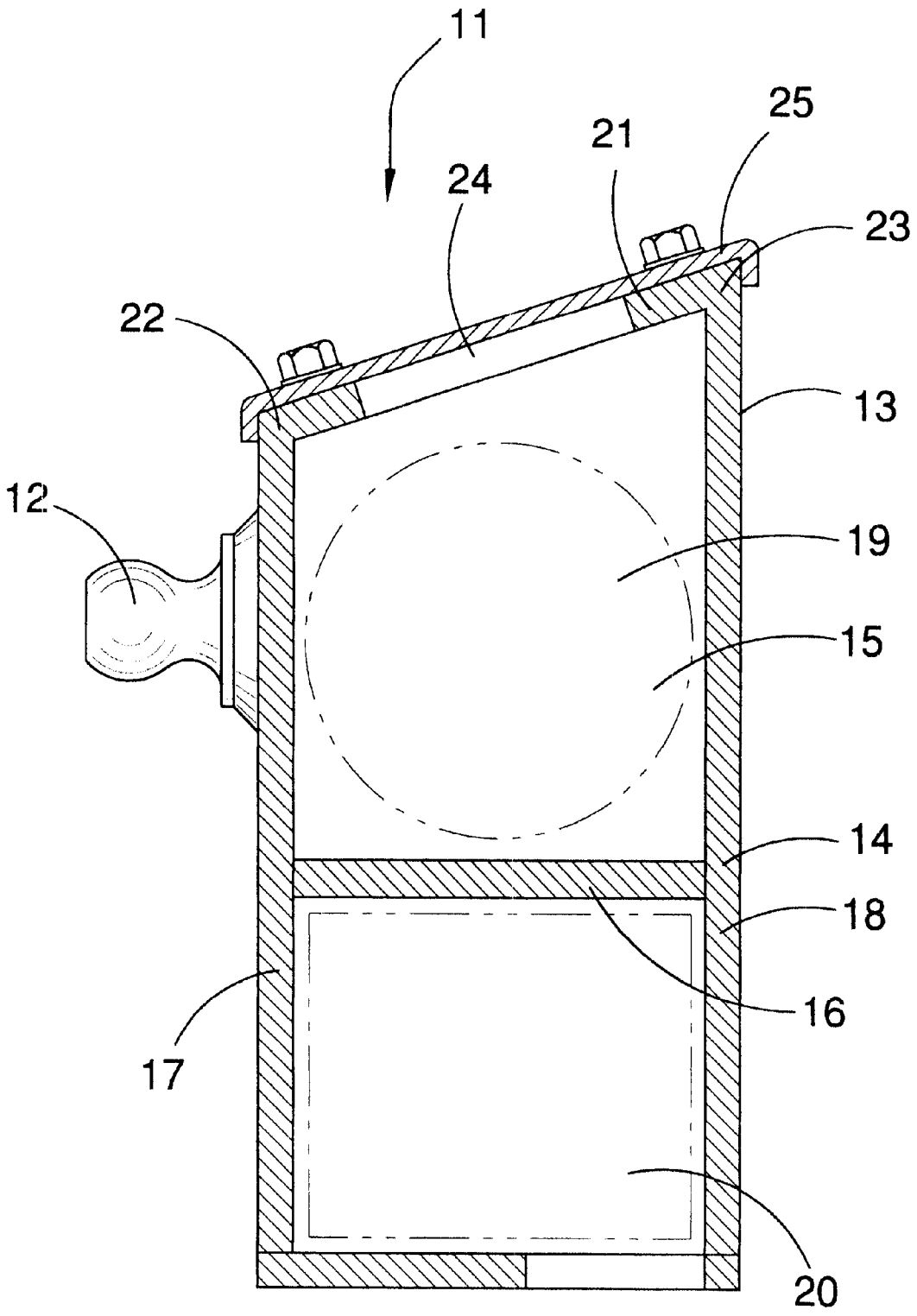
FIG. 6 is a cross-sectional view of one of the sleeve assemblies of the present invention taken along line 6—6 of FIG. 3.

With reference now to the drawings, and in particular to FIGS. 1 through 6 thereof, a new blade angle adjustment system embodying the principles and concepts of the present invention and generally designated by the reference numeral 10 will be described.

As best illustrated in FIGS. 1 through 6, the blade angle adjustment system 10 generally comprises a pair of sleeve assemblies 11 each being designed for being slidably coupled to one of a pair of lifting arms of the bulldozer. Each of the sleeve assemblies 11 comprises a mounting member 12 coupled to a main portion 13 of an associated one of the sleeve assemblies 11. The mounting member 12 of each of the sleeve assemblies 11 is designed for pivotally receiving one of a pair of pivot arms of the bulldozer whereby each of the pivot arms is pivotable with respect to the associated one of the lifting arms, each of the sleeve assemblies 11 is designed for being coupled to one of a pair of extending rams of the bulldozer whereby lengthening of one of the extending rams slides the associated one of the sleeve assemblies 11 along the associated one of the lifting arms for changing the positioning of one of the pivot arms with respect to the other of the pivot arms to angle the blade with respect to a body of the bulldozer.

Each of the sleeve assemblies 11 comprises a perimeter wall 14. The perimeter wall 14 defines a lumen 15 extending through the associated one of the sleeve assemblies 11. The lumen 15 of each the sleeve assemblies 11 is designed for slidably receiving one of the lifting arms of the bulldozer for permitting the associated one of the sleeve assemblies 11 to be slidably positioned along the associated one of the lifting arms.

Each of the sleeve assemblies 11 comprises a medial wall 16. The medial wall 16 is coupled between an exterior wall 17 and an interior wall 18 of the perimeter wall 14 of the associated one of the sleeve assemblies 11 whereby the medial wall 16 divides the lumen 15 into an upper portion 19 and a lower portion 20. The lower portion 20 of the lumen 15 is designed for receiving one of lifting arms of the bulldozer. The upper portion 19 of the lumen 15 is designed for permitting hydraulic lines and the associated one of the extending rams of the bulldozer to pass through the sleeve assemblies 11. The medial wall 16 separates the hydraulic lines from the lifting arm to prevent the hydraulic lines from becoming pinched between the lifting arm and the perimeter wall 14 of the associated one of the sleeve assemblies 1I1 and rupturing one of the hydraulic lines.

The perimeter wall 14 of the each of the sleeve assemblies 11 comprises a top wall 21. The top wall 21 extends between a top edge 22 of the exterior wall 17 and an upper edge 23 of the interior wall 18. The top wall 21 comprises a plurality of access apertures 24 extending through the top wall 21 whereby each of the access apertures 24 are designed for permitting access to the hydraulic lines and the associated one of the extending arms passing through the upper portion 19 of the lumen 15 of the associated one of the sleeve assemblies 11.

Each of the sleeve assemblies 11 comprises a plurality of cover plates 25. Each of the cover plates 25 is selectively coupled to the top wall 21 of the perimeter wall 14 whereby each of the cover plates 25 is positioned over one of the access apertures 24. Each of the cover plates 25 is designed for inhibiting debris from becoming lodged in the upper portion 19 of the lumen 15.

Each of the sleeve assemblies 11 comprises a pair of attachment tabs 26. Each of the tabs outwardly extends from the perimeter wall 14 whereby the attachment tabs 26 are positioned in a spaced relationship. The attachment tabs 26 are designed for being oppositely positioned around one of the extending rams of the bulldozer whereby the attachment tabs 26 are designed for being coupled to the associated one of the extending rams to secure the associated one of the sleeve assemblies 11 to the associated one of the extending rams.

Each of the attachment tabs 26 of the sleeve assemblies 11 comprises a bore 27. The bore 27 of one of the attachment tabs 26 is aligned with the bore 27 of the other of the attachment tabs 26 of the associated one of the sleeve assemblies 11. The bore 27 of each of the attachment tabs 26 is designed for receiving a mounting pin whereby the mounting pin pivotally couples the associated one of the extending rams to the associated one of the sleeve assemblies 11.

In use, the user disconnects the pivot arms from the lifting arms. Each of the lifting arms is then inserted into the lower portion 20 of the lumen 15 of one of the sleeve assemblies 11. The each of pivot arms are then coupled to the mounting member 12 of the associated one of the sleeve assemblies 11. Each of the extending rams of the bulldozer are extended through the upper portion 19 of the lumen 15 and coupled to the attachment tabs 26 of the associated one of the sleeve assemblies 11. The user can then control the angle of the blade with respect to the body of the bulldozer from the cab by lengthening one of the extending rams and pushing the associated one of the sleeve assemblies 11 along the lifting arm to push one side of the blade ahead of the other to angle to blade with respect to the body of the bulldozer.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A blade angle adjustment system for allowing a user to change the angle of a blade on a bulldozer while remaining positioned within a cab of the bulldozer, the blade angle adjustment system comprising:

a pair of sleeve assemblies each being adapted for being slidably coupled to one of a pair of lifting arms of the bulldozer, each of said sleeve assemblies comprising a mounting member coupled to a main portion of an associated one of said sleeve assemblies, said mounting member of each of said sleeve assemblies being adapted for pivotally receiving one of a pair of pivot arms of the bulldozer such that each of the pivot arms is pivotable with respect to the associated one of said lifting arms; each of said sleeve assemblies being adapted for being coupled to one of a pair of extending rams of the bulldozer such that lengthening of one of the extending rams slides the associated one of said sleeve assemblies along the associated one of the lifting arms for changing the positioning of one of the pivot arms with respect to the other of the pivot arms to angle the blade with respect to a body of the bulldozer.

2. The blade angle adjustment system as set forth in claim 1, further comprising:

each of said sleeve assemblies comprising a perimeter wall, said perimeter wall defining a lumen extending through the associated one of said sleeve assemblies, said lumen of each said sleeve assemblies being adapted for slidably receiving one of the lifting arms of the bulldozer for permitting the associated one of said sleeve assemblies to be slidably positioned along the associated one of the lifting arms.

3. The blade angle adjustment system as set forth in claim 2, further comprising:

each of said sleeve assemblies comprising a medial wall, said medial wall being coupled between an exterior wall and an interior wall of said perimeter wall of the associated one of said sleeve assemblies such that said medial wall divides said lumen into an upper portion and a lower portion, said lower portion of said lumen being adapted for receiving one of said lifting arms of the bulldozer, said upper portion of said lumen being adapted for permitting hydraulic lines and the associated one of the extending rams of the bulldozer to pass through said sleeve assemblies.

4. The blade angle adjustment system as set forth in claim 3, further comprising:

said perimeter wall of each of said sleeve assemblies comprising a top wall, said top wall extending between a top edge of said exterior wall and an upper edge of said interior wall, said top wall comprising a plurality of access apertures extending through said top wall such that each of said access apertures are adapted for permitting access to the hydraulic lines and the associated one of said extending rams passing through said upper portion of said lumen of the associated one of said sleeve assemblies.

5. The blade angle adjustment system as set forth in claim 4, further comprising:

each of said sleeve assemblies comprising a plurality of cover plates, each of said cover plates being selectively coupled to said top wall of the perimeter wall such that each of said cover plates is positioned over one of said access apertures, each of said cover plates being adapted for inhibiting debris from becoming lodged in said upper portion of said lumen.

6. The blade angle adjustment system as set forth in claim 2, further comprising:

each of said sleeve assemblies comprising a pair of attachment tabs, each of said tabs outwardly extending from said perimeter wall such that said attachment tabs are positioned in a spaced relationship, said attachment tabs being adapted for being oppositely positioned around one of the extending rams of the bulldozer such that said attachment tabs are adapted for being coupled to the associated one of the extending rams to secure the associated one of the sleeve assemblies to the associated one of the extending rams.

7. The blade angle adjustment system as set forth in claim 6, further comprising:

each of said attachment tabs of said sleeve assemblies comprising a bore, said bore of one of said attachment tabs being aligned with said bore of the other of said attachment tabs of the associated one of said sleeve assemblies, said bore of each of said attachment tabs being adapted for receiving a mounting pin such that the mounting pin couples the associated one of the extending rams to the associated one of said sleeve assemblies.

8. A blade angle adjustment system for allowing a user to change the angle of a blade on a bulldozer while remaining positioned within a cab of the bulldozer, the blade angle adjustment system comprising:

a pair of sleeve assemblies each being adapted for being slidably coupled to one of a pair of lifting arms of the bulldozer, each of said sleeve assemblies comprising a mounting member coupled to a main portion of an associated one of said sleeve assemblies, said mounting member of each of said sleeve assemblies being adapted for pivotally receiving one of a pair of pivot arms of the bulldozer such that each of the pivot arms is pivotable with respect to the associated one of said lifting arms; each of said sleeve assemblies being adapted for being coupled to one of a pair of extending rams of the bulldozer such that lengthening of one of the extending rams slides the associated one of said sleeve assemblies along the associated one of the lifting arms for changing the positioning of one of the pivot arms with respect to the other of the pivot arms to angle the blade with respect to a body of the bulldozer;

each of said sleeve assemblies comprising a perimeter wall, said perimeter wall defining a lumen extending through the associated one of said sleeve assemblies, said lumen of each said sleeve assemblies being adapted for slidably receiving one of the lifting arms of the bulldozer for permitting the associated one of said sleeve assemblies to be slidably positioned along the associated one of the lifting arms;

each of said sleeve assemblies comprising a medial wall, said medial wall being coupled between an exterior wall and an interior wall of said perimeter wall of the associated one of said sleeve assemblies such that said medial wall divides said lumen into an upper portion and a lower portion, said lower portion of said lumen being adapted for receiving one of lifting arms of the bulldozer, said upper portion of said lumen being adapted for permitting hydraulic lines and the associated one of the extending rams of the bulldozer to pass through said sleeve assemblies;

said perimeter wall of said each of said sleeve assemblies comprising a top wall, said top wall extending between a top edge of said exterior wall and an upper edge of said interior wall, said top wall comprising a plurality of access apertures extending through said top wall such that each of said access apertures are adapted for permitting access to the hydraulic lines and the associated one of the extending rams passing through said upper portion of said lumen of the associated one of said sleeve assemblies;

each of said sleeve assemblies comprising a plurality of cover plates, each of said cover plates being selectively coupled to said top wall of the perimeter wall such that each of said cover plates is positioned over one of said access apertures, each of said cover plates being adapted for inhibiting debris from becoming lodged in said upper portion of said lumen;

each of said sleeve assemblies comprising a pair of attachment tabs, each of said tabs outwardly extending from said perimeter wall such that said attachment tabs are positioned in a spaced relationship, said attachment tabs being adapted for being oppositely positioned around one of the extending rams of the bulldozer such that said attachment tabs are adapted for being coupled to the associated one of the extending rams to secure the associated one of the sleeve assemblies to the associated one of the extending rams; and each of said attachment tabs of said sleeve assemblies comprising a bore, said bore of one of said attachment tabs being aligned with said bore of the other of said attachment tabs of the associated one of said sleeve assemblies, said bore of each of said attachment tabs being adapted for receiving a mounting pin such that the mounting pin couples the associated one of the extending rams to the associated one of said sleeve assemblies.

* * * * *